US006373387B1

(12) United States Patent
Qiu et al.

(10) Patent No.: US 6,373,387 B1
(45) Date of Patent: Apr. 16, 2002

(54) INTEGRATED HYBRID ELECTRONIC ARTICLE SURVEILLANCE MARKER

(75) Inventors: An Qiu, Colorado Springs, CO (US); Ryusuke Hasegawa, Morristown, NJ (US)

(73) Assignee: Honeywell International Inc., Morris Township, NJ (US)

( * ) Notice: Subject to any disclaimer, the term of this patent is extended or adjusted under 35 U.S.C. 154(b) by 0 days.

(21) Appl. No.: 09/634,121

(22) Filed: Aug. 8, 2000

(51) Int. Cl.[7] ..... G08B 13/14

(52) U.S. Cl. ..... 340/572.1; 340/572.5; 340/572.4; 340/572.6; 340/572.7

(58) Field of Search ..... 340/572.1, 572.5, 340/572.7, 572.4, 572.6, 10.1, 10.34

(56) References Cited

U.S. PATENT DOCUMENTS

| | | | | | |
|---|---|---|---|---|---|
| 4,413,254 | A | * | 11/1983 | Pinneo et al. | 340/572 |
| 4,745,401 | A | | 5/1988 | Montean | 340/572 |
| 5,291,180 | A | * | 3/1994 | Reeb | 340/572 |
| 5,812,065 | A | * | 9/1998 | Schrott et al. | 340/572 |
| 5,939,984 | A | * | 8/1999 | Brady et al. | 340/572 |
| 6,045,652 | A | * | 4/2000 | Tuttle et al. | 156/292 |
| 6,107,920 | A | * | 8/2000 | Eberhardt et al. | 340/572.7 |
| 6,130,612 | A | * | 10/2000 | Castellano et al. | 340/572.6 |
| 6,154,137 | A | * | 11/2000 | Goff et al. | 340/572.4 |
| 6,177,870 | B1 | * | 1/2001 | Lian et al. | 340/572.5 |

FOREIGN PATENT DOCUMENTS

| | | |
|---|---|---|
| FR | 2 701 146 | 8/1994 |

* cited by examiner

*Primary Examiner*—John Tweel
(74) *Attorney, Agent, or Firm*—Roger H. Criss

(57) ABSTRACT

An integrated deactivatable hybrid marker is disclosed which can be used both in radio frequency and magnetic harmonic article surveillance systems. The harmonics generating element or elements of the marker are inserted into a RF resonant circuit as an active part of the circuit. The deactivation of the marker is accomplished by employing another element of high coercivity magnetic material. When placed in a RF interrogation field, the hybrid marker causes an increase in absorption of transmitted signal in order to reduce the signal in the receiving coil of the RF surveillance system. When placed in an interrogation zone of a magnetic harmonic article surveillance system, the marker generates high harmonics of the interrogating frequency that can be detected by the receiver of the surveillance system. In addition both the RF and harmonic functions of the hybrid marker can be deactivated by a single process. Furthermore, the use of conductive paste material to print the RF circuits is disclosed to achieve a low cost manufacturing process.

8 Claims, 5 Drawing Sheets

INTEGRATED HYBRID ELECTRONIC ARTICLE SURVEILLANCE MARKER

BACKGROUND OF THE INVENTION

1. Field of the Invention

This invention relates to electronic article surveillance systems (EAS) and markers for use therein. More particularly, the invention provides an integrated hybrid tag which can be detected by both a magnetic harmonic article surveillance system and a radio frequency article surveillance system.

2. Description of the Prior Art

The problem of protecting articles of merchandise in stores against shoplifting has been the subject of numerous technical solutions. Among these solutions is securing a tag or marker to an article to be protected. The marker responds to an interrogation signal from transmitting apparatus situated at an exit door of the store. A receiving coil on the opposite side of the exit door receives a signal produced by the marker in response to the interrogation signal. The presence of the response signal indicates that the marker has not been removed or deactivated by the cashier, and that the article bearing it may not have been paid for or properly checked out.

A number of different types of markers have been widely used. In one type, the functional portion of the marker consists of an electrical resonant circuit. When placed in an electromagnetic field transmitted by the interrogation apparatus, the resonant circuit marker causes an increase in absorption of the transmitted signal in order to reduce the signal in the receiving coil. The detection of the signal level change indicates the presence of the marker. A commercially used marker of this type is operated at radio frequency (RF) region, e.g. 8.2 MHz, and referred as an RF tag.

A second type of marker consists of an elongated element of a ferromagnetic material having a high magnetic permeability placed adjacent to a second element of a ferromagnetic material having a higher coercivity than the first element. When subjected to an electromagnetic radiation at an interrogation frequency, the marker causes high harmonics of the interrogation frequency to be developed in the receiving coil. Detection of such harmonics indicates the presence of the marker. Deactivation of the marker is accomplished by changing the magnetization state of the second element. Thus, when the marker is exposed to a dc magnetic field, the magnetization state in the second element changes and the amplitude of the harmonic chosen for detection is significantly changed. This change can be readily detected in the receiving coil. This is a typical magnetic harmonic EAS tag. A commonly used interrogation frequency for the harmonic tag is in the range of a few thousand Hertz.

The most economic way to affix the anti-theft marker onto merchandise is during the manufacturing process on the production line. However, both the radio frequency tag and the magnetic harmonic tag described above are widely used in various retail stores. At the merchandise manufacturing stage, there is no knowledge of which store the merchandise is going to and what type of detecting system will be used. As a result, the manufacturer would have to put both types of tags on the merchandise. Also, at the check-out counter of a retail store, the cashier would have to deactivate both tags to eliminate false alarm even though the store only uses one kind of detection system. Installing two separate markers at the merchandise manufacture would cause operational complications and overall cost increase.

The object of this invention is to make a deactivatable hybrid marker that can be detected by both RF detection and harmonic detection systems. One type of a hybrid marker was disclosed in French Pat. No. 2,701,146 issued in 1994. However, in that patent, the hybrid marker merely consists of two types of markers, i.e. an RF marker and a harmonic marker, arranged on one substrate. The RF part of the marker and the harmonic part of the marker are separated from each other in the proposed design. Also, there is no deactivation function designed.

The present invention provides an integrated hybrid marker. The harmonic part of the marker is an active part of the RF resonant circuit. Also, the present hybrid marker can be deactivated in a single process.

SUMMARY OF THE INVENTION

The present invention provides an integrated hybrid marker comprising a harmonic element made of a strip of a high magnetic permeability material which is inserted into a RF circuit as an active part of the resonant circuit. The electrical contact between the element and the rest of the circuit is achieved by using conductive paste material. The deactivation of the marker is accomplished by employing another element of a magnetic material having a high coercivity.

When placed in a RF interrogation field, the hybrid marker causes an increase in absorption of the transmitted signal reducing the signal in the receiving coil of the RF surveillance system. When placed in an interrogation zone of a magnetic harmonic article surveillance system, the marker generates high harmonics of the interrogation frequency that can be detected by the receiver of the surveillance system. The hybrid marker can be deactivated in both RF and harmonic functions by a single process.

BRIEF DESCRIPTION OF THE DRAWINGS

The invention will be more fully understood and further advantages will become apparent when reference is made to the following detailed description of a preferred embodiment of the invention and the accompanying drawings in which.

DETAILED DESCRIPTION OF THE INVENTION

Figure 1:
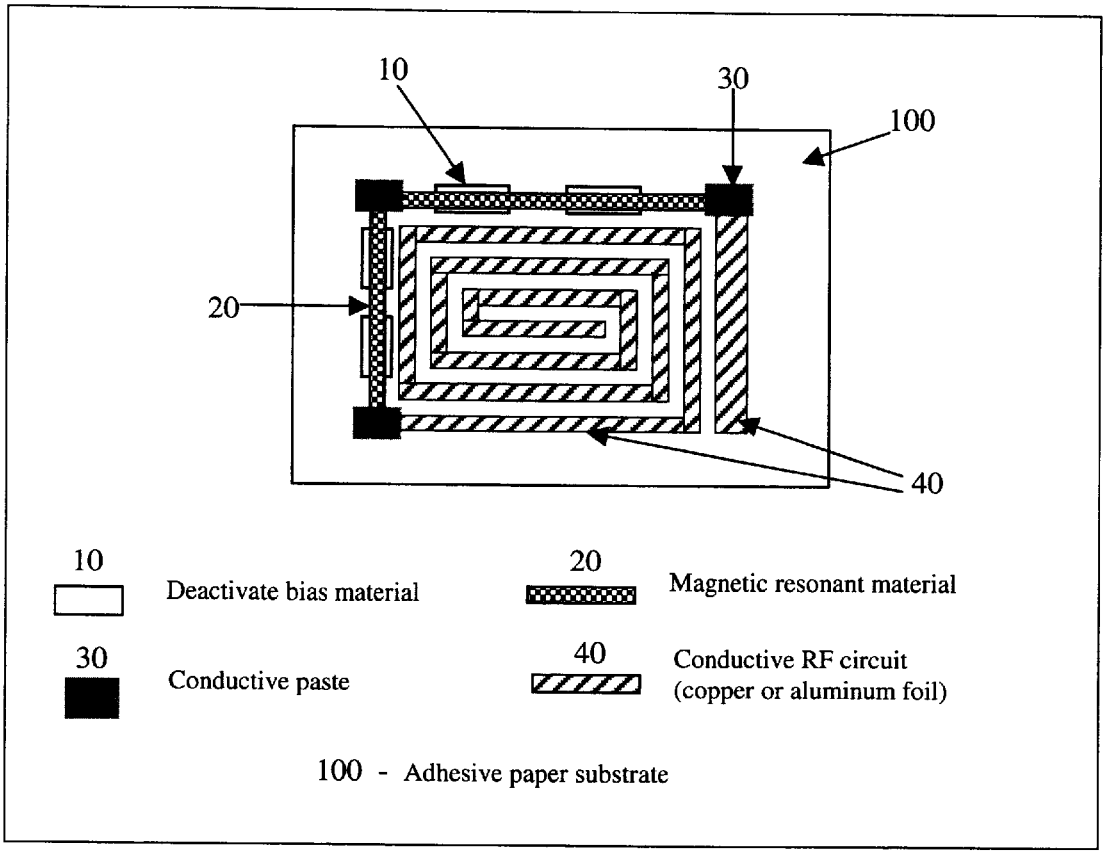
FIG. 1 is a schematic drawing showing a RF circuit integrated with harmonic elements.
Figure 2:
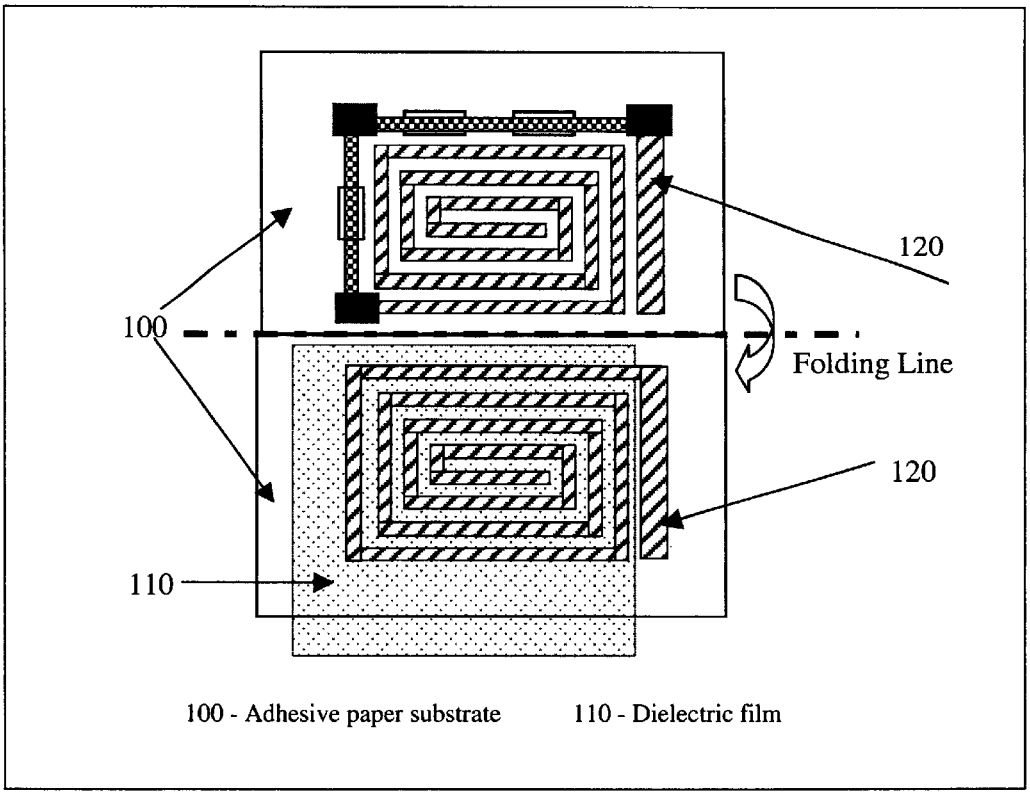
FIG. 2 is a schematic drawing showing another way to construct a complete hybrid marker by utilizing the RF circuit of FIG. 1.

Referring to FIG. 1 and FIG. 2 of the drawings, an integrated hybrid marker was fabricated as following:

(1) The RF circuit, made from copper or aluminum foil 40, was laid down on an adhesive paper substrate 100;

(2) The deactivating elements 10, made of a high coercivity magnetic material, were also placed on the adhesive paper substrate 100;

(3) The harmonic elements 20, made of a material having a high magnetic permeability, were then placed on top of the deactivating elements 10 to complete the circuit with the conductive foil 40. Two strips of amorphous metal material, made from Honeywell International Inc. METGLAS® 2714A, for example, having a width of about 1 mm and a total length of about 76 mm were used; and (4) The electrical contact between the conductive circuit 40 and the harmonic material 20, as well as between the harmonic materials, were made by utilizing a conductive paste 30, such as silver paint in this case.

As shown in FIG. 2, the circuit of the present invention was then folded with another copper foil circuit. These two circuits were aligned face-to-face, and a plastic film 110 was placed between the two circuits. The plastic film is a dielectric material between the two circuits and functions as a capacitor of the RF resonance circuit. To secure the stable structure of the marker, double-sided adhesive plastic films were used. One line of the circuit, 120, was kept uncovered by the plastic film. And two such uncovered lines 120 in the opposite circuits were glued using conductive paste to complete the RF resonant circuit.

The hybrid tag, or marker, was tested in both radio frequency (RF) and magnetic harmonic detection systems. In the RF detection system, a standard 8.2 MHz frequency was employed. When the marker was exposed to a RF field within the interrogation zone, the signal in the receiver coil dropped by more than 30%. Under the same testing condition, a commercial RF tag showed a 55% reduction of the signal in the receiver coil.

In the harmonic detection system, a fundamental frequency of 2,500 Hz was employed and the $25^{th}$ harmonic was selected to detect. The hybrid marker generated a signal of 130 mV in the testing system. For comparison, a commercial harmonic tag was also tested by the same detection system. The commercial harmonic tag had a length of about 90 mm. The $25^{th}$ harmonic signal of the commercial tag was about 250 mV under the same test condition.

When deactivated by using a dc magnetic field, the strength of which was high enough to saturate the harmonic marker, the hybrid marker did not show any detectable harmonic signal. Also the deactivated marker did not respond to the RF interrogation field. The signal in the receiver coil of the RF surveillance system did not change by the presence of a deactivated marker. Therefore, by applying a dc magnetic field, the hybrid marker was deactivated in both harmonic and RF functions. The deactivation mechanism of the RF function is such that electrical contact of amorphous metal material and copper circuit is disturbed during the magnetic deactivation. The contacts are made by conductive paint so that the mechanical and electrical links between the two parts are made strong enough to maintain the RF function intact prior to deactivation. Upon deactivation, a loose contact increases the electrical resistance of the RF circuit and drives the circuit out of the resonant condition at the interrogation frequency.

The marker design described above, therefore, produces a true integrated hybrid marker with a sufficiently high signal in both harmonic and RF detection systems. Also the hybrid markers can be totally deactivated by a single process.

Figure 3:
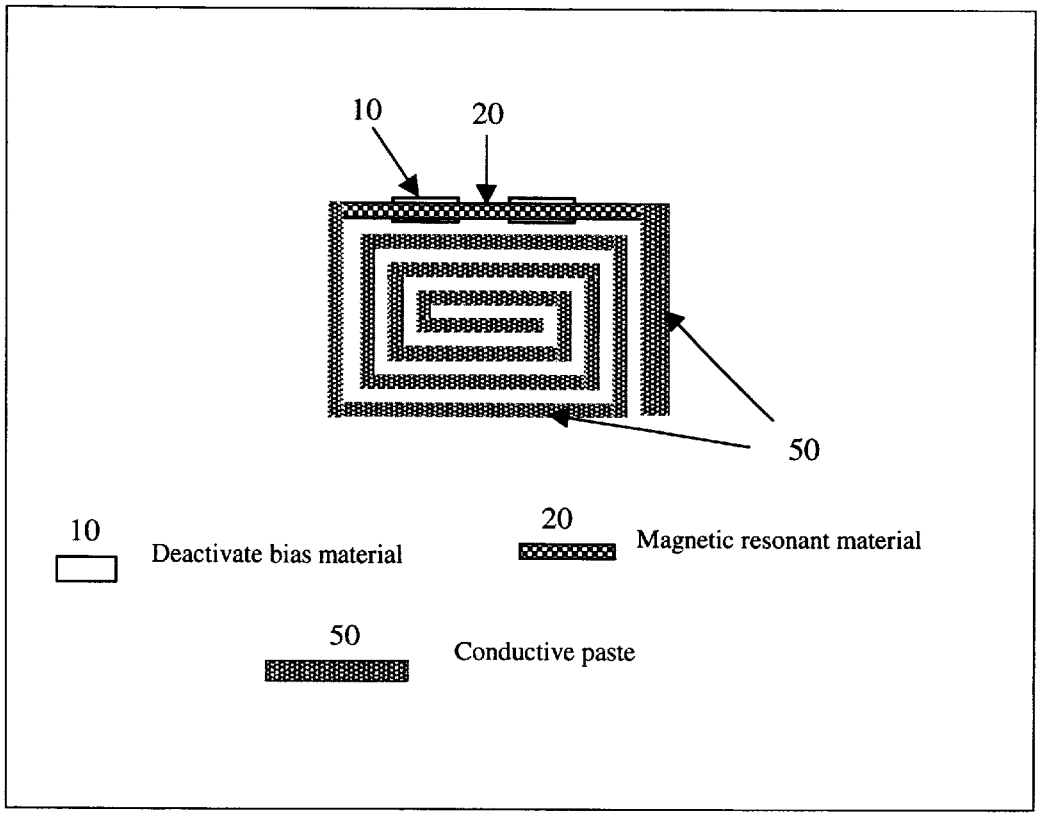
FIG. 3 is a schematic drawing showing a RF circuit made using conductive paste.
Figure 4:
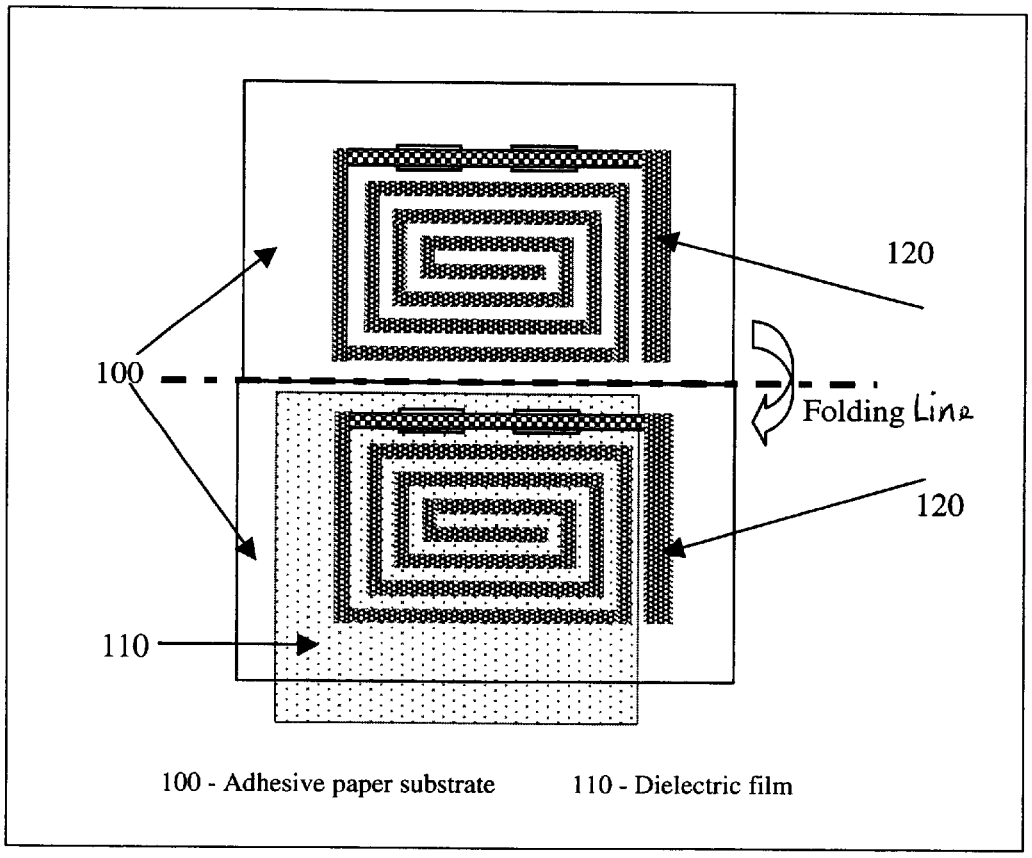
FIG. 4 is a schematic drawing showing another way to construct a hybrid marker utilizing the RF circuit printed using conductive paste.

Another way to make the hybrid marker is shown in FIGS. 3 and 4 of the drawings. First, the deactivation elements 10 and harmonic element 20 are placed on an adhesive paper substrate as described above. Then the RF circuit 50, as well as the electrical contacts with the amorphous metal part, is printed on the paper using a conductive paste. The two circuits of the same type are then folded together face to face with a plastic sheet in between. One arm of the circuit, 120, is not covered by the plastic sheet and is glued to the opposite side using conductive glue. In this way, the hybrid tag can be produced on a mass manufacturing scale.

Figure 5:
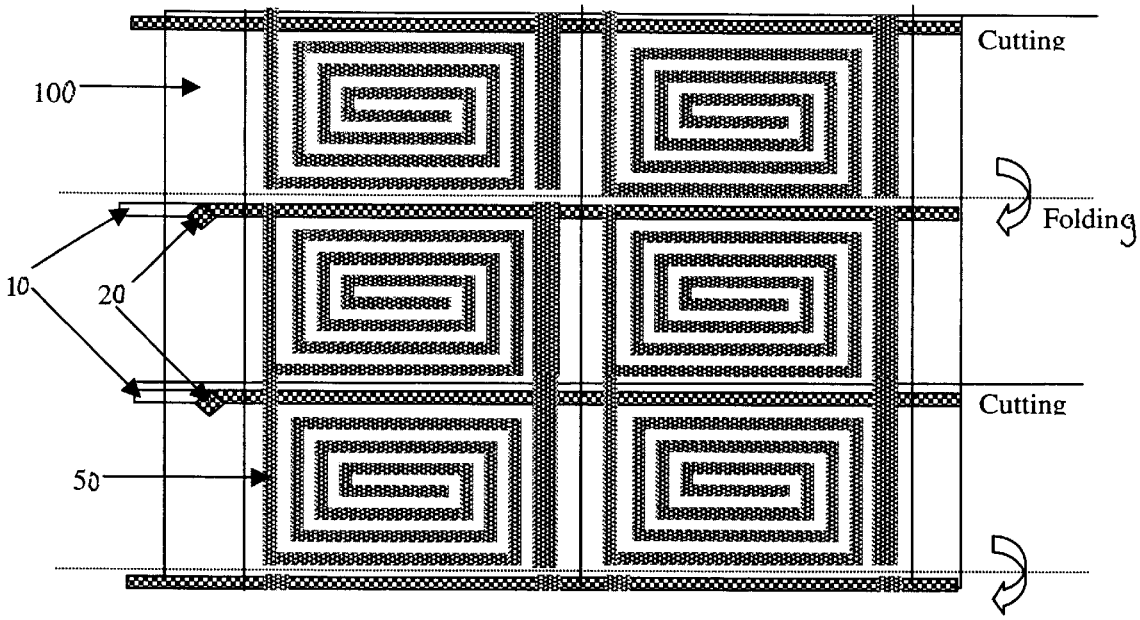
FIG. 5 is a schematic drawing showing a way to manufacture hybrid markers in a mass production process.

An economic way to manufacture a large quantity of the hybrid marker according to the present invention is described in FIG. 5. First, the long strips of a high-coercivity deactivation material, 10, are placed on the adhesive paper, 100. On top of the deactivation strip is a strip of harmonic material, 20, i.e., an amorphous metal material. Then the RF circuits, 50, are printed using conductive paste. The rest of the steps include folding them with a plastic sheet in between, cutting them to individual pieces, and securing the electrical contact between the opposite sides to complete the RF resonant circuit. The whole process can be accomplished on an automated production line.

Having thus described the invention in rather full detail, it will be understood that such detail need not be strictly adhered to but that various changes and modifications may suggest themselves to one skilled in the art, all falling within the scope of the invention as defined by the subjoined claims.

We claim:

1. A hybrid electronic article surveillance marker comprising:

(i) at least one magnetic element for generating harmonics of a fundamental exciting frequency, (ii) a radio frequency resonant circuit, in which the harmonic generating element is an active part of the resonant circuit, and (iii) deactivation elements having a high coercivity, whereby the marker can be deactivated in both radio frequency and harmonic functions by a single process.

2. A marker as recited in claim 1, wherein the harmonic generating element is at least 50 percent amorphous.

3. A marker as recited in claim 1, wherein both the harmonic and radio frequency functions are deactivated by a single process of exposing the marker to a dc magnetic field.

4. A marker as recited in claim 1, wherein the marker includes a paper substrate, and the radio frequency circuit material is a conductive paste printed on the paper substrate to form the radio frequency circuit.

5. A marker as recited in claim 1, wherein a multiple number of pairs of the radio frequency circuit and the harmonics generating element with the deactivation elements attached thereto, are mounted on an adhesive paper substrate, each of said pairs is cut out, folded face-to-face with an insulating film therebetween, and connected electrically to complete the radio frequency circuit.

6. A marker as recited in claim 1, wherein the main part of the radio frequency circuit is selected from the group of metals consisting of copper and aluminum foil, and the electrical contact between the harmonic generating elements and the radio frequency circuit is made by using a conductive paste.

7. A marker as recited in claim 4, wherein the conductive paste serves as an electrical contact between the harmonics generating elements and the radio frequency circuit.

8. An integrated hybrid electronic article surveillance system comprising:

(i) a magnetic harmonic article surveillance system for generating harmonics of a fundamental exiting frequency, (ii) a radio frequency article surveillance system having an electrical resonant circuit, wherein the harmonic generating elements are active parts of the resonant circuit, and (iii) deactivation elements having a high coercivity.

* * * * *